US009926159B2

(12) United States Patent
Jones et al.

(10) Patent No.: US 9,926,159 B2
(45) Date of Patent: Mar. 27, 2018

(54) PRESS ROLLER SPRING FRAME

(71) Applicant: Ingersoll-Rand Company, Davidson, NC (US)

(72) Inventors: Anthony A. Jones, Maple Valley, WA (US); Paul M. Codd, Seattle, WA (US)

(73) Assignee: Ingersoll-Rand Company, Davidson, NC (US)

( * ) Notice: Subject to any disclaimer, the term of this patent is extended or adjusted under 35 U.S.C. 154(b) by 0 days.

(21) Appl. No.: 15/139,593

(22) Filed: Apr. 27, 2016

(65) Prior Publication Data

US 2016/0362268 A1 Dec. 15, 2016

Related U.S. Application Data

(60) Provisional application No. 62/174,399, filed on Jun. 11, 2015.

(51) Int. Cl.
*B65H 18/26* (2006.01)
*B65H 57/14* (2006.01)
(Continued)

(52) U.S. Cl.
CPC ..... *B65H 18/26* (2013.01); *B65H 54/52* (2013.01); *B65H 57/14* (2013.01); *B65H 57/26* (2013.01);
(Continued)

(58) Field of Classification Search
CPC ..... B65H 57/14; B65H 57/26; B65H 18/26; B65H 54/52; B65H 2402/5441;
(Continued)

(56) References Cited

U.S. PATENT DOCUMENTS 1,526,087 A 2/1925 Anker
2,254,255 A 9/1941 Zeruneith
(Continued)

FOREIGN PATENT DOCUMENTS

EP 1591390 A1 11/2005
WO 00/17081 A1 3/2000

OTHER PUBLICATIONS

Machine Translation of EP 1 591 390 A1, dated Nov. 2, 2005.*
(Continued)

*Primary Examiner* — William E Dondero
(74) *Attorney, Agent, or Firm* — Sunstone IP

(57) ABSTRACT

A press roller spring frame is provided. The spring frame includes a frame body having a first section having an arcuate shape, a second section extending from the first section and having a substantially planar shape, a third section extending from the first section and having a substantially planar shape. The second and third sections are configured to oppose one another with the first section therebetween. The spring frame further includes a roller operatively coupled to the third section and configured to rotate about an axis. A compressive force may be applied to the roller to displace the third section closer to the second section, whereby the arcuate shape of the first member is compressed. The compression causes the first member to produce a spring force that resists the compressive force applied against the roller to keep the roller against the object applying the compressive force.

11 Claims, 3 Drawing Sheets

(51) Int. Cl.
*B65H 54/52* (2006.01)
*B65H 57/28* (2006.01)
*B65H 57/26* (2006.01)

(52) U.S. Cl.
CPC ..... *B65H 2402/5441* (2013.01); *B65H 2404/1521* (2013.01)

(58) Field of Classification Search
CPC .. B65H 2404/1521; B66D 1/36; B66D 1/365; B66D 1/38; B66D 2700/0191
See application file for complete search history.

(56) References Cited

U.S. PATENT DOCUMENTS

| | | | | |
|---|---|---|---|---|
| 5,803,437 | A * | 9/1998 | Paterson | B66D 1/14 254/276 |
| 6,006,044 | A | 12/1999 | Okuno | |
| 2002/0121567 | A1 * | 9/2002 | Kamoda | G03B 1/04 242/358.1 |
| 2004/0108405 | A1 | 6/2004 | Linder | |

OTHER PUBLICATIONS

European Search Report dated Oct. 21, 2016 from European Patent Application No. 16171488.6 filed May 26, 2016.
Examination Report dated Feb. 1, 2018 from European Patent Application No. 16171488.6 filed May 26, 2016.

* cited by examiner

PRESS ROLLER SPRING FRAME

CROSS REFERENCE TO RELATED APPLICATION

This application claims priority to U.S. Provisional Patent Application No. 62/174,399, filed Jun. 11, 2016, the disclosure of which is hereby incorporated entirely herein by reference.

BACKGROUND

Technical Field

The present disclosure relates to press rollers. More particularly, the disclosure relates to a press roller of a press roller system.

State of the Art

Wire, paper, rope, chain, cable, string, cord, and other similar linear-shaped materials can be looped, coiled, wound, or otherwise wrapped around a drum or other cylindrical shape that thereby acts as a spool. Wrapping a linear material around a spool is a convenient and efficient method of storing, distributing, and/or dispensing any length of the material.

Efficiently wrapping the material about the spool entails wrapping each loop of the material next to the previous loop in a back-and-forth manner along the axial length of the spool, layer upon layer, until the desired length of the material is positioned on the spool. In this manner, unwanted space between sequential loops of the linear material is avoided and the amount of material on the spool is maximized.

To facilitate the wrapping of the material around the spool, the spool is oftentimes configured to spin about an axis. This permits the material to be held in place while the spool is rotated, which rotation pulls the length of material onto the spool. To assist further, tension may be applied to the material to keep the material taught with respect to the spool. Such tension not only assists in the process of applying the material to the spool, but can also help prevent spool over-run, backlash, and/or "birdnesting."

Backlash or "birdnesting" occurs when the tension in the material is reduced and/or the spool under-rotates or reverses course, either of which causes the material to become loose on the spool. Loose material about the spool permits the material to unravel, bunch up, and tangle on itself, such that loose loops of the material wrap around, under, and over each other in a knot or series of knots that look much like a bird's nest.

The desire to prevent backlash and "birdnesting" is present in the relevant arts and preventative measures have been introduced. Many of these preventative measures include complicated components and costly parts. For example, current preventative measures include fabricated frames that require several precision pieces of metal to be welded to one another. Moreover, to provide the desired backlash prevention, both right-handed and left-handed coil springs (torsion springs) are required to be inserted onto the fabricated frames, not to mention the insertion of rollers onto the same fabricated frame.

It would therefore be advantageous in the relative arts to improve upon these preventative measures and provide a simpler, more efficient, and cost-effective anti-backlash configuration for spools of material.

SUMMARY

The present disclosure relates to press rollers. More particularly, the disclosure relates to a press roller spring frame of a press roller system that prevents backlash of material wrapped about a spool, namely spooled wire rope.

An aspect of the present disclosure includes a spring frame comprising: a frame having opposing members; and a roller operatively coupled to a first member of the opposing members, wherein under a force applied to the roller the opposing members elastically displace.

Another aspect of the present disclosure includes wherein the frame has a substantially A-frame shape with the opposing members forming a substantially arcuate shape at a connection therebetween, wherein the opposing members elastically displace toward one another under the force, wherein the roller rotates about an axis, wherein the axis is substantially orthogonal to a direction of displacement of the opposing members, and wherein the frame is a unitary piece of sheet metal.

Another aspect of the present disclosure includes a spring frame system comprising: an A-frame type frame having a first portion and a second portion with an arcuate portion at a connection between the first and second portions; a spool configured to rotate about a spool axis and having a material thereon; and a member coupled to an exterior face of the first portion, wherein under a force applied to the member by the material on the spool the arcuate portion elastically displaces and the first and second portions advance toward one another.

Another aspect of the present disclosure includes a spring frame system comprising: a spool having a material thereon, the spool rotating about a spool axis; and a spring frame in mechanical communication with the material, wherein the spring frame contacts the material to maintain the material against the spool.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

The drawings depict illustrative embodiments of a press roller spring frame 10 and press roller system 2. These embodiments may each comprise various structural and functional components that complement one another to provide the unique functionality and performance of the press roller spring frame 10 and press roller system 2, the particular structure and function of which will be described in greater detail herein.

Figure 1:
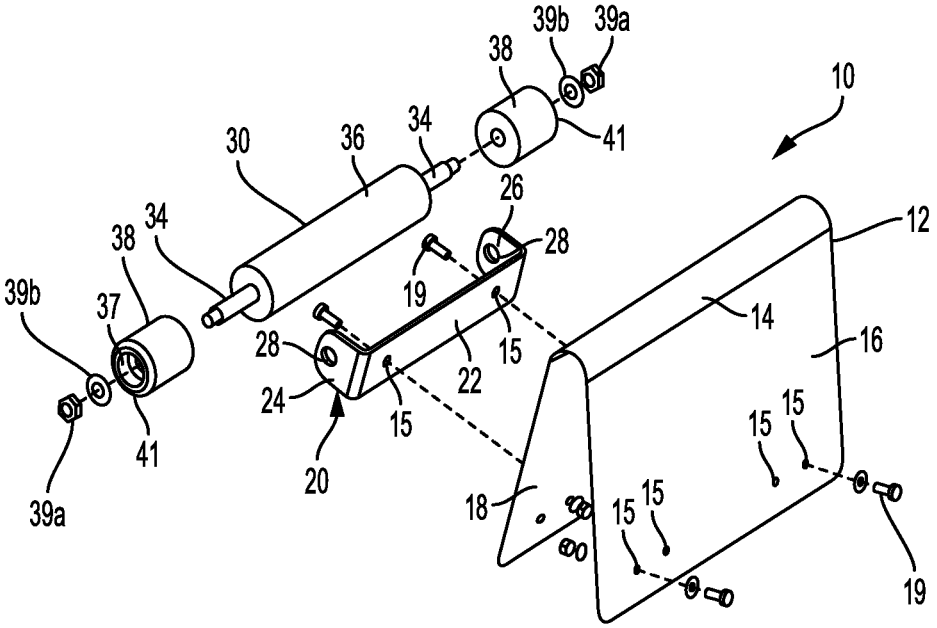
FIG. 1 is an exploded, side-perspective view of an illustrative embodiment of a press roller spring frame in accordance with the present disclosure.

Referring to the drawings, FIG. 1 depicts an illustrative embodiment of a press roller spring frame 10. Embodiments of the press roller spring frame 10 may comprise a frame member 12. The frame member 12 may comprise a first section 14, a second section 16, and a third section 18. The first section 14 may be a portion of the frame member 12 that is positioned between the second section 16 and the third section 18. The first section 14 may be a bowed, curved, or arcuate-shaped section. The second and third sections 16 and 18 may be substantially flat or planar-shaped sections. The second section 16 may extend a length from one end of the first section 14 and the third section 18 may extend a length from the other end of the first section 14, such that the second section 16 and the third section 18 oppose one another with the first section 14 operationally positioned therebetween, as depicted in FIG. 1.

Embodiments of the press roller spring frame 10 may comprise the frame member 12, or frame, being configured and manufactured using one or more techniques and comprised of one or more complimentary components. For example, the frame member 12 may be organized by having the first section 14 and the second section 16 be functionally coupled together at their respective ends by means of fastening, such as welding, adhesive, bolts, pins, screws, nails, and other known fastening members. Likewise, the first section 14 and the third sections 18 may be functionally coupled together at their respective ends by means of fastening, such as welding, adhesive, bolts, pins, screws, nails, and other known fastening members. As such, the first section 14 may be formed into its arcuate shape and have thereafter the second and third sections 16 and 18 attached thereto as described immediately above and as depicted in FIG. 1. The first section 14 may be formed of a type of material having properties that are the same or are different than the properties of the material used to form the second and third sections 16 and 18. For example, the first section 14 may be formed of a flexible metal or alloy that may allow the first section 14 to flex or elastically deform under force or pressure. On the other hand, in some embodiments, the second and third sections 16 and 18 may be formed of metals, alloys, plastics, organic materials, or other rigid materials that can withstand the application of force applied thereon. Thus, as force is applied to the second or third sections 16 or 18, the force may cause the first section 14 to elastically deform, as will be described in greater detail herein.

Alternatively, the frame member 12 may be formed of a solid unitary piece of flexible, elastic, pliant, or otherwise bendable material, such as metals and alloys. For example, the frame member 12 may be a metal or alloy member cast in a mold with the first section 14 operationally positioned between the second and third sections 16 and 18, as depicted in FIG. 1. The frame member 12 manufactured in this way may be formed of metals, alloys, plastics, organic materials, or other rigid materials that can withstand the application of force applied thereon. Thus, as force is applied to the second or third sections 16 or 18, the force may cause the first section 14 to elastically deform, as will be described in greater detail herein.

Further in example, the frame member 12 may be comprised of a single unitary piece of metal or alloy and thereafter formed to the desired shape. For example, a piece of sheet metal may be cut to predetermined dimensions and thereafter formed into the frame member 12 by bending, plastically deforming, or otherwise shaping the first section 14 into the arcuate-shaped section with the substantially planar second section 16 and third section 18 extending therefrom on opposing sides of the arc of the first section 14, as depicted in FIG. 1. In this configuration, as force is applied to the second or third sections 16 or 18, the force may cause the first section 14 to elastically deform, as will be described in greater detail herein. In some embodiments, the sheet metal of the frame member 12 may be sheet 14 gage or 2 mm-17-7 ph stainless steel solution annealed. The arcuate shape of the first section 14 may be formed by bending the sheet metal in a brake press at or near the midpoint along the length of the sheet, such that the second and third members 16 and 18 may have substantially the same length, measured from the arc ends of the first section 14 after the first section 14 is bent. The radius of the arcuate shape of the first section 14 may be determined and established, as needed, according to the compressive forces desired based on the specific application in which the frame member 12 will be utilized. Moreover, once formed into the frame member 12, the sheet metal may be heat treated, such as by precipitation hardening, to bring forth the physical and operational properties of the frame member 12, which will be discussed in greater detail herein.

Embodiments of the frame member 12 may further comprise one or more holes 15 being positioned in one or both of the second and third sections 16 and 18. The holes 15 may be configured to receive a fastener 19 or a means of fastening, such as a nut and bolt or other known fasteners. The fastener 19 may be inserted through the hole 15 in the second section 16 and operate to functionally and/or structurally couple the second section 16 and thus the plate member 12 to other components of the press roller system 2, such as a support 4, to be described in greater detail. The fastener 19 may be inserted through the hole 15 in the third section 18 and operate to functionally and/or structurally couple the third section 18 of the plate member 12 to other components of the press roller spring frame 10, such as a bracket 20.

Embodiments of the press roller spring frame 10 may comprise the bracket 20. The bracket 20 may comprise a main body 22 having first and second ends 24 and 26 that are configured to protrude or extend perpendicularly from the main body 22. The first and second ends 24 and 26 may have configured therein an aperture 28. The aperture 28 may be configured to receive therein and retain an axle 34 of a roller 30, to be described in greater detail. The bracket 20 may comprise one or more holes 15 positioned in the main body 22. The holes 15 may be configured to receive a fastener 19 or a means of fastening, such as a nut and bolt or other known fasteners. The fastener 19 may be inserted through the hole 15 and operate to functionally and/or structurally couple the main body 22 to the plate member 12. In particular, fastener 19 may be inserted through the hole 15 to functionally and/or physically couple the main body 22 of the bracket 20 to at least a portion of the third section 18, such that the bracket 20 is releasably secured to the plate member 12.

Embodiments of the press roller spring frame 10 may further comprise the bracket 20 comprising first and second ends 24*a* and 26*a* (not depicted) that are each independently and separately coupled to at least a portion of the third section 18, without the need of the main body 22. Each of the first and second ends 24*a* and 26*a* may comprise holes 15 through which the fastener 19 may be utilized to couple the ends 24*a* and 26*a* to the third section 18. Alternatively, each of the first and second ends 24*a* and 26*a* may be coupled to the third section 18 by fastening means such as welding, adhesive, friction fit, crimping, and other known fastening method and techniques. Each of these first and second ends 24*a* and 26*a* may further comprise a respective aperture 28 that is configured to receive therein and retain an axle 34 of the roller 30, such that the roller 30 is configured between the first and second ends 24*a* and 26*a*.

Embodiments of the press roller spring frame 10 may further comprise the bracket 20 being part and portion of the third section 18. For example, portions of the third section 18 may be cut, folded or otherwise manipulated to create perpendicular portions (not depicted) that protrude or extend perpendicularly from the third section 18. These perpendicular portions of the third section 18 may therefore function in a manner similar to the function of the first and second ends 24 and 26 described above. These perpendicular portions of the third section 18 may also comprise the apertures 28 described above that are configured to receive therein and retain an axle 34 of a roller 30, such that the roller 30 is configured between the perpendicular portions of the third section 18.

Figure 3:
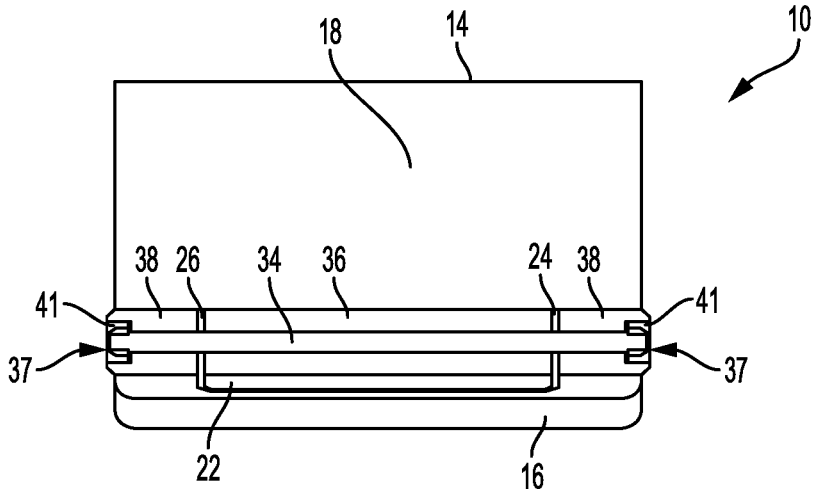
FIG. 3 is a cross-sectional view taken along line A-A of FIG. 2 of the illustrative embodiment of a press roller spring frame in accordance with the present disclosure.

Embodiments of the press roller spring frame 10 may further comprise the roller 30. The roller 30 may be comprised of one or more roller parts, including for example a central roller 36 and an outer roller 38 on either end of the central roller 36, as illustratively depicted in FIGS. 1 and 3. Each of the central roller 36 and the outer rollers 38 may be configured to be inserted onto an axle 34, about which the central roller 36 and outer rollers 38 may independently spin, turn, or otherwise rotate. Each of the outer rollers 38 may have an annular recess 37 on an end thereof. As stated previously, the axle 34, and thus the roller 30, may be supported in its operation by the apertures 28. To form the roller 30, the central roller 36 may be inserted between the first and second ends 24 and 26 of the bracket 20 and the axle 34 may thereafter be inserted through one of the first and second ends 24 and 26, through the central roller 36 and through the remaining one of the first and second ends 24 and 26. The outer rollers 38 may thereafter be inserted over the ends of the axle 34 that protrude out from each of the first and second ends 24 and 26, such that the annular recess 37 of each of the outer rollers 38 is visible and the axle 34 is visible within the annular recess 37. In this way, one or more fastening members 39*a* and 39*b* may be inserted into the annular recess 37 to physically and functionally engage the distal end of the axle 34 to secure the outer roller 38 on the axle 34 and prevent the outer roller 38 from falling off the axle 34. The fastening members 39*a* and 39*b* may be, for example, a nut, a washer, a pin, a rivet, etc. In the circumstance that the fastening member 39*a* is a nut and 39*b* is a washer, then the distal end of the axle 34 may be a threaded bolt configured to receive and engage the nut. With the fastening members 39*a* and 39*b* set within the annular recess 37, the distal end 41 of each outer roller 38 extends beyond the fastening member 39, as depicted in FIG. 3. Moreover, by positioning the first and second ends 24 and 26 of the bracket 20 between the central roller 36 and the outer rollers 38, the first and second ends 24 and 26 are kept from extending beyond the distal end 41 of each outer roller 38. As such, the opposing distal ends 41 are the furthermost end points of the roller 30, as depicted in FIG. 3.

Figure 2:
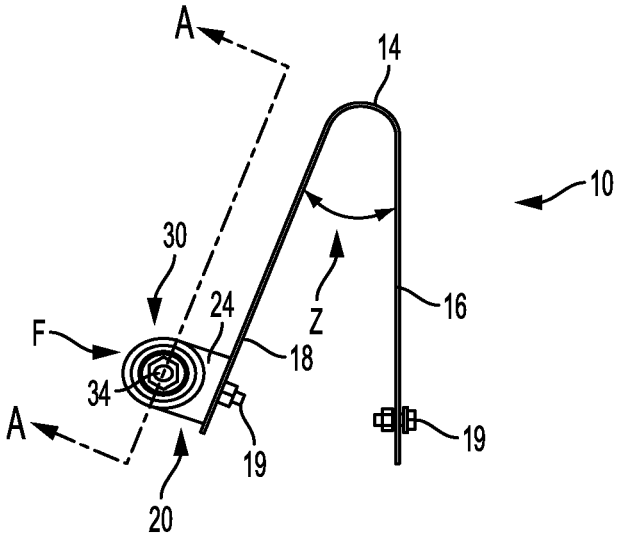
FIG. 2 is a side view of an illustrative embodiment of a press roller spring frame in accordance with the present disclosure.

Referring again to the drawings, FIG. 2 depicts an illustrative embodiment of the press roller spring frame 10. Embodiments of the press roller spring frame 10 may comprise an angle Z defined between the second and third sections 16 and 18. The operation and function of the press roller spring frame 10 comes to life as the angle Z is reduced by application of force F on the roller 30. Specifically, under applied force F exerted against the roller 30, the force F attempts to reduce the measure of the angle Z by forcing the third section 18 toward the second section 16 to further bend the arcuate shape of the first section 14. However, the spring force stored in the arcuate shape of the first section 14 resists the force F and serves to prevent the third section 18 from advancing toward the second section 16, to the extent that it can. In this way, the spring force exerted by the first section 14 in opposition to the applied force F operates to press the roller 30 firmly against whatever object is pressing on the roller 30 to exert the applied force F.

Figure 4:
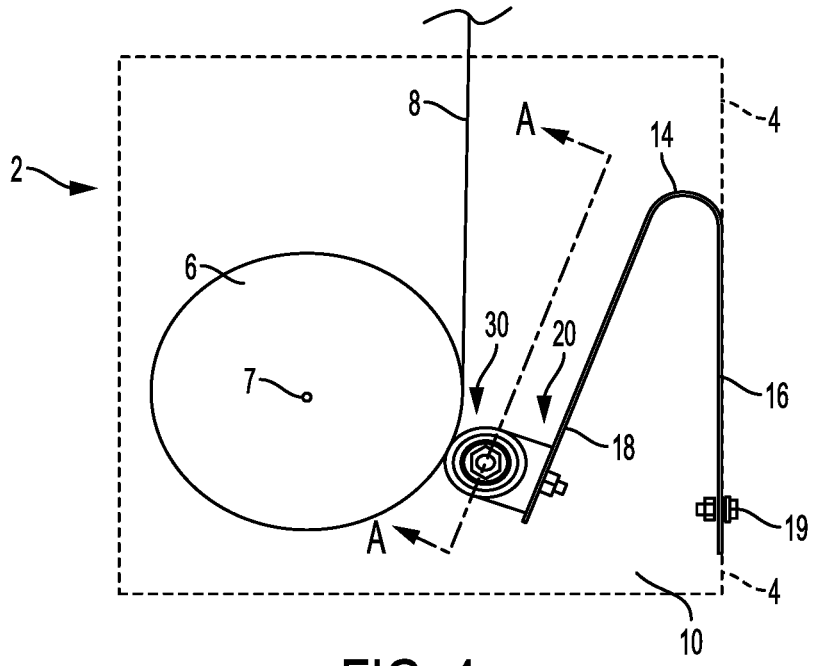
FIG. 4 is a side view of an illustrative embodiment of a press roller spring frame as part of a press roller system in operational engagement with a drum of spooled wire rope in accordance with the present disclosure.

Referring again to the drawings, FIG. 4 depicts an illustrative embodiment of the press roller system 2, of which the press roller spring frame 10 may comprise a part. The press roller system 2 may further comprise a support 4, a drum or spool 6, a material 8, such as a wire, and the press roller spring frame 10. The support 4, depicted in the Figures with dashed lines, may be a frame member, frame assembly, or other support structure, including for example a winch assembly. The support 4 may be configured to house the drum or spool 6. The drum or spool 6 may further comprise an axis 7 about which the spool 6 may rotate. The axis 7 may be physically coupled or engaged by the support 4. With the axis 7 supported by the support 4, the spool 6 may rotate freely about the axis 7 with respect to the support 4. The spool 6 may be configured to receive thereon the material 8, hereinafter referred to as the wire 8. As the spool 6 rotates about the axis 7, the rotation thereof may pull a length of the wire 8 onto the spool 6. As such, the length of the wire 8 may be wrapped about the diameter of the spool 6 in sequential loops, layer upon layer, until the desired length of the wire 8 is placed on the spool 6. The wire 8 may be, for example, any material capable of being wrapped about a spool, such as cable, wire rope, rope, wire, cord, or other linear-shaped material that is capable of being wrapped about a cylindrical shape. Further, as the wire 8 is wrapped about the spool 6, tension may be placed on the wire 8 to keep the wire 8 taught with respect to the spool 6.

Embodiments of the press roller system 2 may further comprise the press roller spring frame 10. The press roller spring frame 10 may be configured within the support 4 so as to be physically supported by the support 4 while also in functional engagement with the spool 6 and wire 8. Specifically, the second section 16 may be releasably coupled to the support 4 by way of one or more fasteners 19 being inserted through the holes 15 in the second section 16 and corresponding holes in the support 4 to releasably fasten together in structural and functional engagement the second section 16 and the support 4, as depicted in FIG. 4. With the frame member 12 structurally supported by the support 4, the roller 30 may be physically configured in the support 4 to functionally and physically engage the spool 6 and the wire 8 on the spool 6. Embodiments of the press roller system 2 may further comprise the spool 6 being added within the support 4 after the press roller spring frame 10 has been positioned within the support 4. In this manner, the spool 6 and wire 8 on the spool 6 may be brought into physical contact and functional engagement with the roller 30. Embodiments of the press roller system 2 may further comprise the spool 6 being added within the support 4 prior to the press roller spring frame 10 being positioned within the support 4. In this manner, the roller 30 may be brought into physical contact and functional engagement with the spool 6 and the wire 8 on the spool 6.

Embodiments of the press roller system 2, including the press roller spring frame 10, may operate to prevent the wire 8 from becoming tangled, snarled, jumbled, or otherwise disorganized on the spool 6. In operation, the spool 6 presses against the roller 30, or the roller 30 presses against the spool 6, to provide the applied force F discussed above. In response, the spring force stored in the first section 14 resists the force F and presses the roller 30 back against the spool 6, or the spool 6 against the roller 30. Moreover, as the spool 6 rotates, the roller 30 likewise rotates, thereby allowing the spool 6 and the roller 30 to remain in physical contact and functional engagement even while the spool 6 and/or the roller 30 rotates.

Embodiments of the press roller system 2, including the press roller spring frame 10 may comprise the roller 30 being positioned against the spool 6 at or near the point where the wire 8 begins to wrap around the spool 6. In this configuration, the roller 30 may guide the application of the wire 8 onto the spool 6 at the desired location on the spool 6 (i.e., next to the previous loop of wire 8) and thereafter prevent the wrapped loops of wire 8 on the spool 6 from unwrapping, dislodging, or otherwise moving in an undesired manner.

Embodiments of the press roller system 2, including the press roller spring frame 10 may comprise the press roller spring frame 10 adapting to the number of layers of wire 8 on the spool 6. For example, as more wire 8 is wrapped about the spool 6, multiple layers of the wire 8 are created, which layers increase the diameter of the spool 6. As the diameter of the spool 6 increases, the spool 6 applies the force F against the third section 18 to push the third section 18 closer to the second section 16 of the spring frame 12, causing the spring frame 12 to elastically deform at the first section 14. Yet, the press roller spring frame 10 is configured to accommodate the applied force F resulting from the increased number of layers of the wire 8 about the spool 6. As described above, the first section 14 of the frame member 12 is configured to elastically deform under the applied force F, but not plastically deform. As a result, even as the number of layers of the wire 8 increase, thus causing increased compressive force on the first section 14, the spring force of the first section 14 nevertheless continues to elastically resist the increased compressive force and provide the opposing force that maintains the roller 30 in physical and functional engagement with the layers of wire 8 on the spool 6. Moreover, as the compression force increases, due to the increased diameter of the spool 6, or more accurately the multiple layers of wire 8 on the spool 6, the spring force likewise increases, due in large part to the increased compression on the first section 14. In other words, the more the first section 14 is compressed, the greater the resulting spring force.

Figure 5:
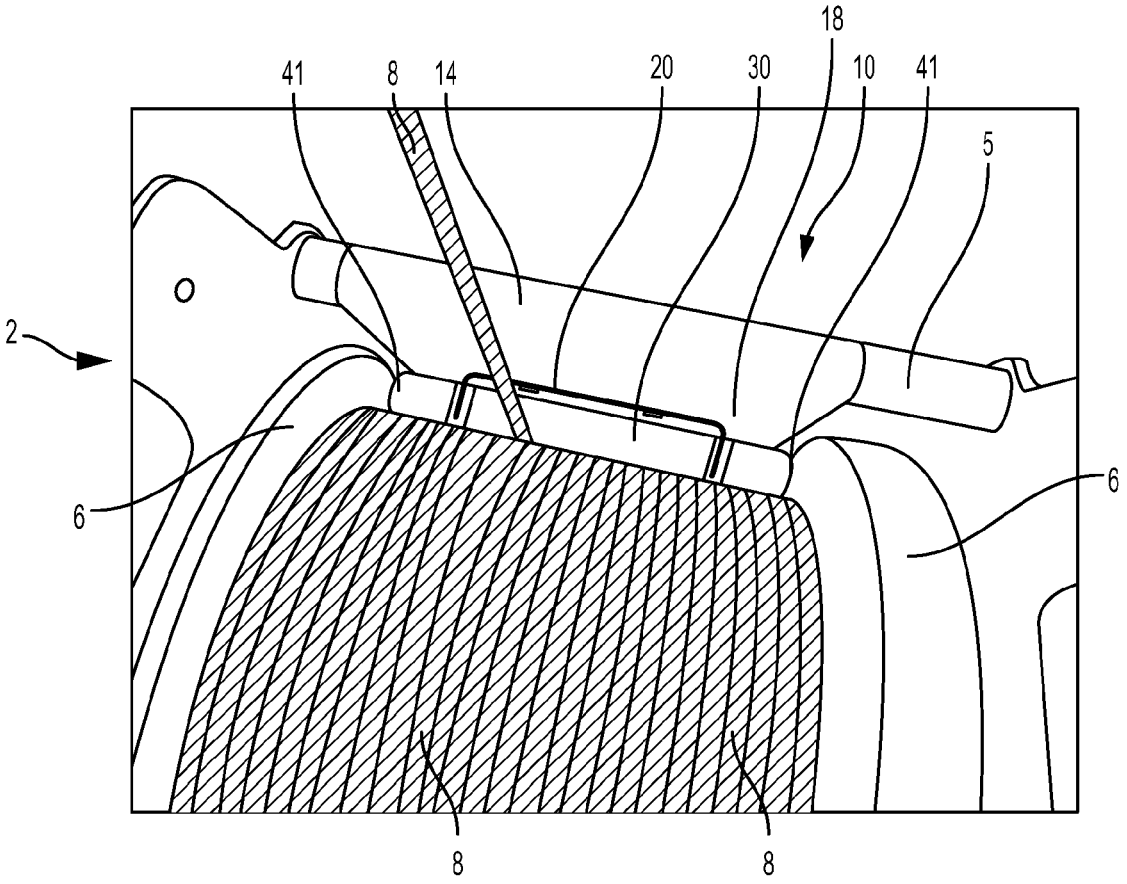
FIG. 5 is a top view of an illustrative embodiment of a press roller spring frame as part of a press roller system in operational engagement with a drum of spooled wire rope in accordance with the present disclosure.

Referring again to the drawings, FIG. 5 depicts an illustrative embodiment of the press roller system 2, of which the press roller spring frame 10 comprises a part. As the spool 6 rotates within the support 4, the wire 8 can be threaded onto the spool in a loop-by-loop, side-by-side, sequential manner, as depicted. As the wire 8 contacts the spool 6, the wire 8 may pass between the roller 30 and the spool 6 (or previous layer of wire 8), such that the roller 30 may guide the placement of the wire 8 in the correct position on the spool 6 (or previous layer of wire 8). The wire 8 on the spool 6 may press against the roller 30 to cause the third section 18 to move closer to the second section 16, thus compressing the first section 14. Yet the spring force of the first section 14 resists the compressive force F applied by the wire 8 on the spool 6 and presses the roller 30 back against the wire 8 on the spool 6, or stated another way, maintains the roller 30 in physical and functional engagement with the wire 8 on the spool 6 to prevent the wire 8 from "birdnesting."

Embodiments of the press roller system 2, including the press roller spring frame 10 may comprise the roller 30 being configured to press against the spool 6 or the wire 8 on the spool 6 across the entire width of the spool 6, the width being defined between outer exterior walls of the spool 6. As described herein, the roller 30 may comprise a central roller 36 and two outer rollers 38 that all together comprise the roller 30 and perform its collective function. Further, with the first and second ends 24 and 26 of the bracket 20 being operatively coupled to the axle 34 of the roller 30 between the central roller 36 and the outer rollers 38, the distal ends 41 of each of the outer rollers 38 are the furthermost points of the roller 30. As such, the roller 30, from distal end 41 to opposing distal end 41, may contact the spool 6 and the wire 8 on the spool 6 across the entire width of the spool 6, as illustratively depicted in FIG. 5. In this manner, none of the loops of the wire 8 on the spool 6 can escape the physical contact of the roller 30.

Embodiments of the press roller system 2, including the press roller spring frame 10 may comprise a stabilizing member 5 configured to support the frame member 12 at or near the first section 14, or even underneath the first section 14 between the second and third sections 16 and 18, respectively. In this manner, the third section 18 may be coupled to the support 4 and the A-frame shaped frame member 12 may be supported under the first section 14 by the stabilizing member 5. Also, the spool axis 7 may be coupled to the support 4 to support the spool 6 within the support 4. In this way, both the press roller spring frame 10 and the spool 6 are respectively secured to the support 4, such that the spring frame 10 and the spool 6 cannot retreat from one another under the application of forces to the system 2, the spring frame 10 or the spool 6. Understandably, under these forces, the spring frame 10 may be configured to elastically deform as the spool receives more and more material 8 thereon. The stabilizing member 5 may be configured to further secure the spring frame 10 to the support 2 to allow the first, second, and third sections, 14, 16, and 18, respectively, to elastically deform.

In addition to the components of the press roller system 2 and the press roller spring frame 10 described above, methods of wrapping wire about a spool or maintaining wire about a spool may be performed utilizing embodiments of the press roller system 2 and the press roller spring frame 10 herein described. The method may comprise providing a spool and a wire to be wrapped about the spool. The method may further comprise providing a press roller spring frame, such as that described herein. The method may comprise inserting the spool and the press roller spring frame within the press roller system, such that they functionally engage one another in a manner consistent with the present disclosure. The method may further comprise threading the wire onto the spool by rotating the spool and maintaining the roller pressed against the spool as the wire is threaded thereon. Pressing the roller against the spool or maintaining the roller against the wire on the spool may be achieved by utilization of the press roller spring frame 10 described herein in conjunction with the press roller system 2.

Furthermore, the components defining the above-described press roller spring frame 10 and spring roller system 2 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, 3-D printing, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A spring frame system comprising:

a spool having a material thereon, the spool rotating about a spool axis;

a spring frame in mechanical communication with the material, wherein the spring frame contacts the material to maintain the material against the spool, wherein the spring frame has opposing members forming a substantially A-frame shape with the opposing members forming a substantially arcuate shape at a connection therebetween, and wherein the substantially arcuate shape elastically displaces under an application of force from the material; and a stabilizer positioned between the opposing members and proximate the substantially arcuate shape, such that the substantially arcuate shape elastically deforms about the stabilizer.

2. The system of claim 1, further comprising a member coupled to the spring frame, wherein the member contacts the material to maintain the position of the material against the spool.

3. The system of claim 2, wherein the member is a roller.

4. The system of claim 1, wherein the material is a wire.

5. The system of claim 1, further comprising a support, wherein the spool axis and the spring frame are coupled to the support.

6. The system of claim 1, wherein the spring frame is a unitary piece of sheet metal.

7. The system of claim 1, further comprising a member and a support, wherein the member couples to a distal end of one of the opposing members and the support couples to a distal end of another of the opposing members, the opposing members having a length substantially equal to one another, the member configured to contact the material to maintain the position of the material against the spool and the support configured to retain the spring frame in position with respect to the spool.

8. A spring frame system comprising:

an A-frame type frame having a first section and a second section with an arcuate section at a connection between the opposing members;

a spool configured to rotate about a spool axis and having a material thereon;

a stabilizer positioned between the opposing members and proximate the arcuate section; and a member coupled to an exterior face of the first section, wherein under a force applied to the member by the material on the spool the arcuate section elastically deforms about the stabilizer and the first and second sections advance toward one another.

9. The system of claim 8, wherein the member is a roller configured to rotate about a roller axis.

10. The system of claim 9, wherein the spool axis and the roller axis are substantially parallel, and wherein under the force the spool rotates about the spool axis and the roller rotates about the roller axis with the material therebetween.

11. The system of claim 10, further comprising a support, wherein the spool axis and the second section are coupled to the support.

* * * * *